US011660623B2

(12) United States Patent
Hofman

(10) Patent No.: US 11,660,623 B2
(45) Date of Patent: May 30, 2023

(54) SHOWERHEAD ASSEMBLY WITH OSCILLATING NOZZLE

(71) Applicant: ETL, LLC, Sparks, NV (US)

(72) Inventor: David Hofman, Reno, NV (US)

(73) Assignee: ETL, LLC, Sparks, NV (US)

( * ) Notice: Subject to any disclaimer, the term of this patent is extended or adjusted under 35 U.S.C. 154(b) by 193 days.

(21) Appl. No.: 17/157,786

(22) Filed: Jan. 25, 2021

(65) Prior Publication Data

US 2022/0062927 A1 Mar. 3, 2022

Related U.S. Application Data

(60) Provisional application No. 63/074,412, filed on Sep. 3, 2020.

(51) Int. Cl.
*B05B 3/16* (2006.01)
*E03C 1/04* (2006.01)

(52) U.S. Cl.
CPC ..... *B05B 3/16* (2013.01); *E03C 1/0408* (2013.01)

(58) Field of Classification Search
CPC .. B05B 3/16; B05B 3/18; B05B 3/044; B05B 1/185; E03C 1/0408
USPC ..... 239/240, 242
See application file for complete search history.

(56) References Cited

U.S. PATENT DOCUMENTS 3,498,543 A * 3/1970 Gilmour ..... B05B 3/044 239/242
4,261,514 A * 4/1981 Kennard ..... B05B 3/00 239/242
4,588,130 A 5/1986 Trenary et al.
5,215,258 A 6/1993 Jursich
5,433,384 A 7/1995 Chan et al.
5,476,225 A 12/1995 Chan
5,704,547 A 1/1998 Golan et al.
6,360,967 B1 3/2002 Schorn
D515,661 S 2/2006 Hughes et al.
7,014,128 B2 * 3/2006 Leung ..... E03C 1/0408 239/242
7,770,820 B2 8/2010 Clearman et al.
D649,623 S 11/2011 Flowers
D669,962 S 10/2012 Schoenherr et al.
D695,357 S 11/2013 Brodey et al.
D710,973 S 8/2014 Madsen
8,794,543 B2 8/2014 Leber
(Continued)

*Primary Examiner* — Qingzhang Zhou
*Assistant Examiner* — Joel Zhou
(74) *Attorney, Agent, or Firm* — One LLP

(57) ABSTRACT

A showerhead assembly is provided which includes a conduit, a gear train and oscillating nozzle chamber. The gear train includes a propeller, toothed pinion, and large toothed gear. Water flows from the conduit into an internal chamber within the showerhead housing. Specifically, water enters the propeller thereby causing it to rotate, the rotation of which causes the pinion to rotate, and consequently, the large gear to revolve. Additionally, a pin seated on the large gear engages with the pin slot located on the nozzle chamber and causes the chamber to pivot, thereby restricting chamber movement as the pin oscillates with rotation of the large gear. Further, the chamber's horizontal movement is hindered by two shoulder arms. As water exits the large gear, it travels through the left shoulder arm's central channel and into the oscillating chamber, whereby it expels through the nozzle outlet in a reciprocating spray pattern.

3 Claims, 8 Drawing Sheets

(56) References Cited

U.S. PATENT DOCUMENTS

| | | | |
|---|---|---|---|
| 9,895,701 | B2 | 2/2018 | Tian et al. |
| 2019/0143348 | A1 | 5/2019 | Quinn et al. |

* cited by examiner

SHOWERHEAD ASSEMBLY WITH OSCILLATING NOZZLE

RELATED APPLICATIONS

The present application claims benefit of U.S. Provisional Patent Application Ser. No. 63/074,412 filed on Sep. 3, 2020.

BACKGROUND OF THE INVENTION

The present invention relates to showerheads. More particularly, the present invention relates to showerhead spray nozzles that pivot up and down or side-to-side so as to produce an oscillating spray pattern.

Showerheads are commercially available in numerous designs and configurations for use in showers, faucets, spas, sprinklers and other personal and industrial systems. The vast majority of showerheads include spray heads which provide constant or pulsed sprays and have either fixed or adjustable openings. Stationary spray heads with fixed jets are the simplest constructions consisting essentially of a central conduit connected to one or more spray nozzles directed to produce a constant pattern. The stationary spray showerheads cause water to flow through the construction to contact essentially the same points on a user's body in a repetitive fashion.

Multifunction showerheads are able to deliver water in many different spray patterns such as a fine spray, a coarse spray, a pulsating spray, or even a flood pattern providing high fluid flow but decreased velocity. Of course, many other spray patterns may also be provided.

Many showerhead assemblies allow users to manipulate spray nozzles into various positions and alignments to assist in the cleaning process. Advantageously, some showerhead assemblies include spray nozzles which can direct water to different locations within a shower stall, allowing water to contact desired locations on a user's body. Recently, showerhead assemblies have included settings which allow water to shift from outer and inner nozzles, causing water to project at varying directions onto the user. Unfortunately, these constructions either require the user to manually maneuver the showerhead assembly or the water to alternate between varying nozzles in order to produce a spray pattern that directs water to multiple locations.

Thus, it would further be advantageous to provide a showerhead assembly that included a primary showerhead with one or more oscillating nozzles so as to create a reciprocating spray pattern.

Further, it would be advantageous to provide a showerhead assembly that included nozzle sets containing different spray patterns and multiple nozzles so as to enable the user to create a unique shower experience.

SUMMARY OF THE INVENTION

Briefly, in accordance with the invention, an improved water spraying assembly is provided which includes a gear train and at least one oscillating nozzle chamber system. The water spraying assembly has particular application for use within a showerhead. Accordingly, the preferred water spraying assembly is described as a showerhead assembly.

The primary showerhead can be relatively traditional in construction including a showerhead housing connected to a water source by a neck portion. Additionally, the neck portion includes a conduit having an inlet threadably affixed to a water source pipe. The inlet is in fluid connection with the pipe so as to receive water from it and allow such water to travel through showerhead housing and into the nozzle outlet for ejection. Various showerhead housing and conduit constructions can be determined by those skilled in the art. For example, the showerhead may include a simple housing affixed directly to the pipe of a water source. Alternatively, the showerhead may be of the handheld type including a handle and flexible hose that connects to the pipe of a water source. Moreover, the showerhead may include various modifications of these well-known assemblies such as a combination fixed and handheld showerhead.

Preferably, the conduit's inlet collects water from the water source and empties such water into the housing's water chamber that is in fluid connection with the gear train. The gear train includes three wheel portions: a propeller, toothed pinion, and large toothed gear. Specifically, the water received by the water chamber flows through the propeller portion of the gear train, whereby such water flow causes the propeller to rotate in a counterclockwise direction. The propeller, which is directly below and coupled with the pinion, continues to rotate as water passes through, thereby causing the pinion to rotate in a counterclockwise direction. Additionally, the pinion, which is meshed and in tooth engagement with the large gear, causes the large gear to revolve in a clockwise direction as water flows from the rotating pinion portion and passes through the large gear. Further, a pin is seated on the outer surface of the large gear. The pin is offset from the large gear's central axis which causes the pin to rotate in a circular path as a result of the rotation of the large gear. The water then exits through the central channel housed in the left hollow shoulder arm of the nozzle chamber system.

In a preferred embodiment, the compound gear is mounted to a gear housing by arbors so as to allow the gear train to rotatably pivot with the passage of water. Specifically, the gear housing includes a front plate and a back plate. The front plate is affixed to and secured onto the back plate which forms the cover of the compound gear mechanism. Preferably, the front plate and back plate are circular in shape.

The nozzle chamber system includes two shoulder arms and a cylindrical nozzle housing having a central chamber. In the preferred embodiment, the nozzle chamber system comprises a right solid shoulder arm and a left hollow shoulder arm. Importantly, the two shoulder arms hold the nozzle housing in position along a longitudinal axis. Specifically, the right solid shoulder arm functions as a support arm and is connected to the cylindrical nozzle chamber by an axle. Even more specifically, the left hollow shoulder arm contains a channel and is aligned with and connected to the cylindrical nozzle's central chamber by two rotatable metal spindles and a bearing which allow the nozzle housing to rotate about its longitudinal axis. The two spindles and bearing encircle the exit of the central channel that is in fluid connection with the cylindrical nozzle chamber.

The cylindrical nozzle chamber includes a pin slot and a nozzle outlet. Upon rotation of the large gear, the pin, which is within the nozzle housing's pin slot, also rotates thereby pushing and pulling the nozzle housing in an oscillating movement. This, in turn, causes the axle, bearing and two spindles to oscillate. Specifically, the oscillating pin forces the nozzle chamber to pivot about its longitudinal axis while the shoulder arms hold the nozzle chamber in place, preventing horizontal rotation of the nozzle chamber thereby restricting the oscillating nozzles to an upward and downward direction. Though not shown in the figures, this entire assembly can be rotated 90° so as to have the nozzle chamber rotate about the vertical axis and thereby provide a side-to-side oscillating spray.

Concurrently, water continues to flow through the gear train, passing the oscillating pin, and traveling through the central channel into the nozzle chamber. Water is then ejected out of the nozzle chamber through the nozzle outlet. Specifically, and in combination with the oscillating movement of the nozzle chamber, the water is ejected from the nozzle outlet in a reciprocating spray pattern.

Thus, it is an object of the present invention to provide a spray head assembly having an improved oscillating nozzle compared to previous showerheads.

Furthermore, it is an additional object of the present invention to provide a spray head assembly having an improved construct so as to generate an oscillating spray pattern without the need for multiple nozzles or user intervention.

Other features and advantages of the present invention will be appreciated by those skilled in the art upon reading the detailed description which follows with reference to the drawings.

BRIEF DESCRIPTION OF THE DRAWINGS

These and other, further and more specific objects and advantages of the invention will be apparent to those skilled in the art from the following detailed description thereof, taken in conjunction with the Drawings, in which.

DETAILED DESCRIPTION OF THE INVENTION

Figure 1:
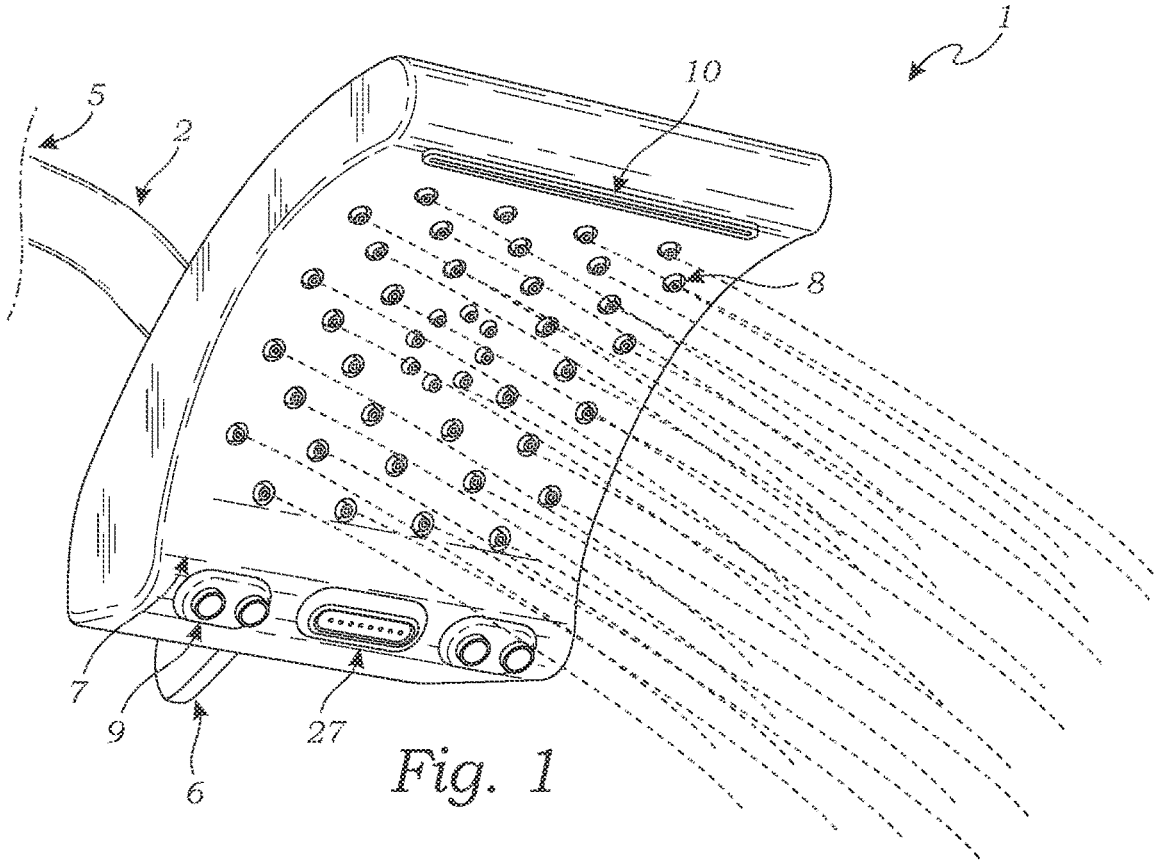
FIG. 1 is a left perspective view of the showerhead assembly wherein the primary nozzles are expelling water.
Figure 2:
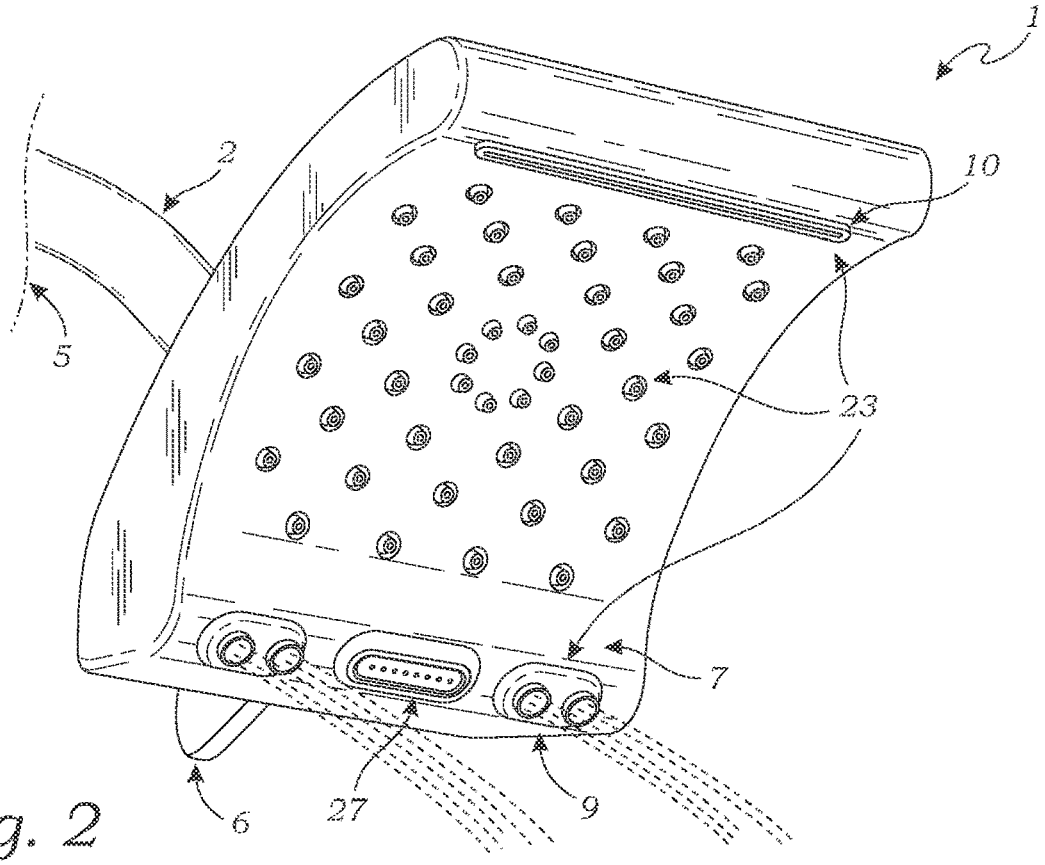
FIG. 2 is a left perspective view of the showerhead assembly illustrated in FIG. 1 wherein the supplemental non-oscillating nozzles are expelling water.
Figure 3:
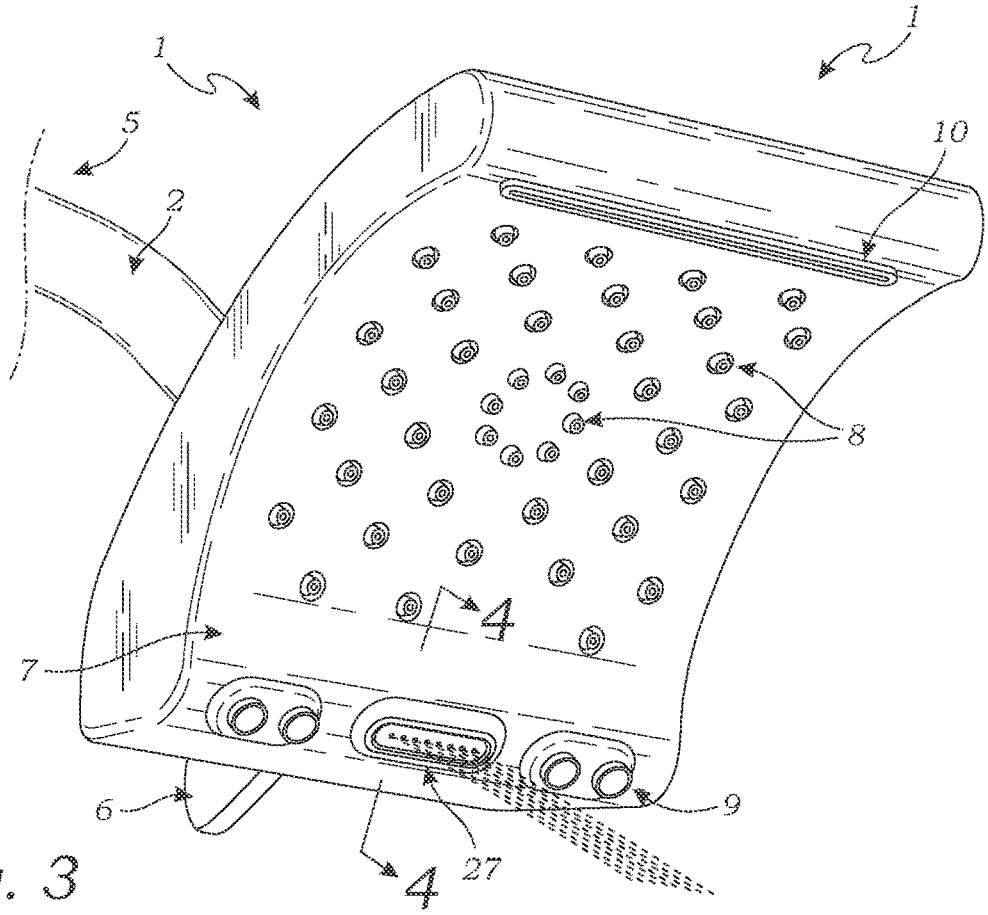
FIG. 3 is a left perspective view of the showerhead assembly illustrated in FIG. 1 wherein the oscillating nozzle is expelling water at its midpoint range of motion.
Figure 4:
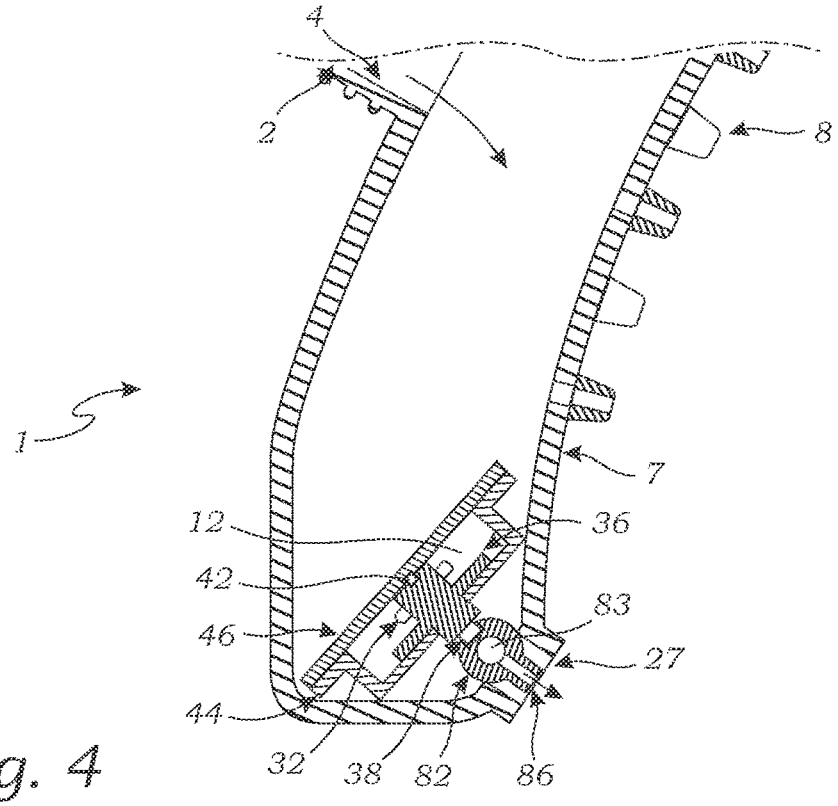
FIG. 4 is a left side cutaway view of the showerhead assembly illustrated in FIG. 1 wherein the compound gear mechanism is housed within the showerhead housing, illustrating the flow of water from the conduit through the gear train, whereby water is released into the nozzle chamber system and ejected from the oscillating nozzle outlet at its midpoint range of motion.
Figure 5:
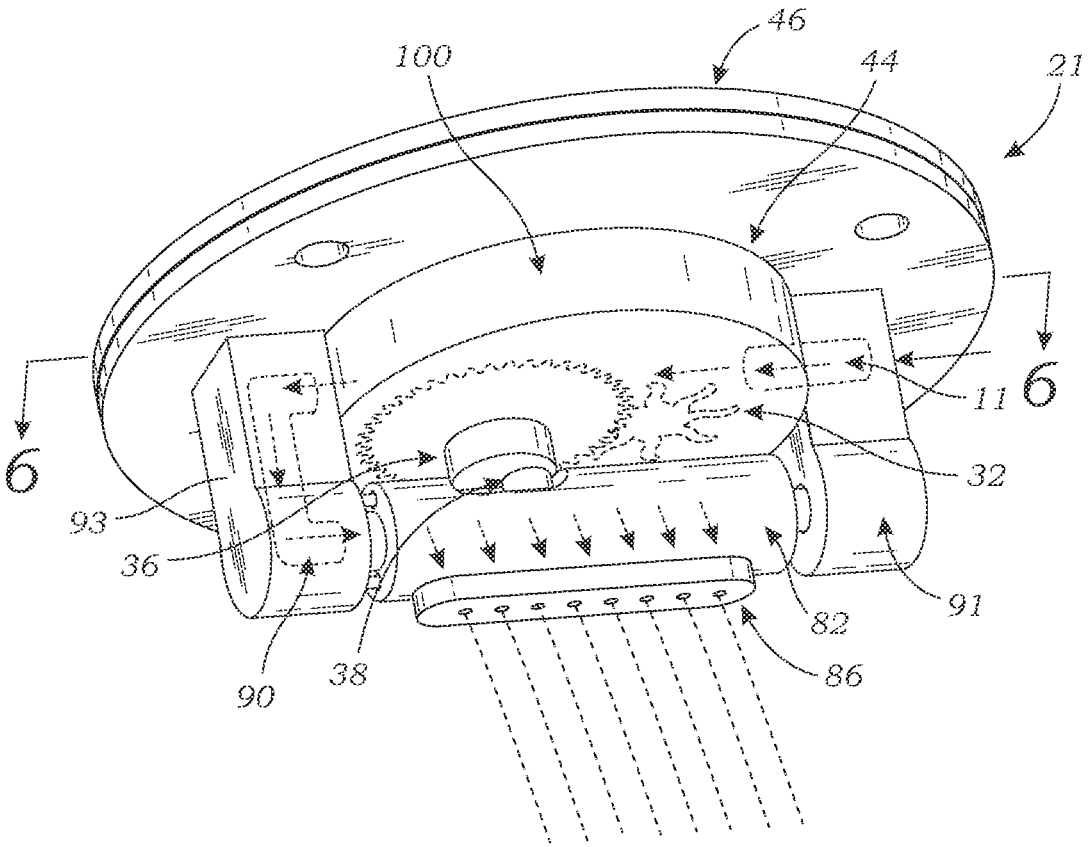
FIG. 5 is a perspective view of the compound gear mechanism illustrated in FIG. 4 illustrating gear train adjoined to the nozzle chamber system and the flow of water from the gear train through nozzle chamber system, whereby such water is ejected from the oscillating nozzle outlet at its midpoint range of motion.
Figure 6:
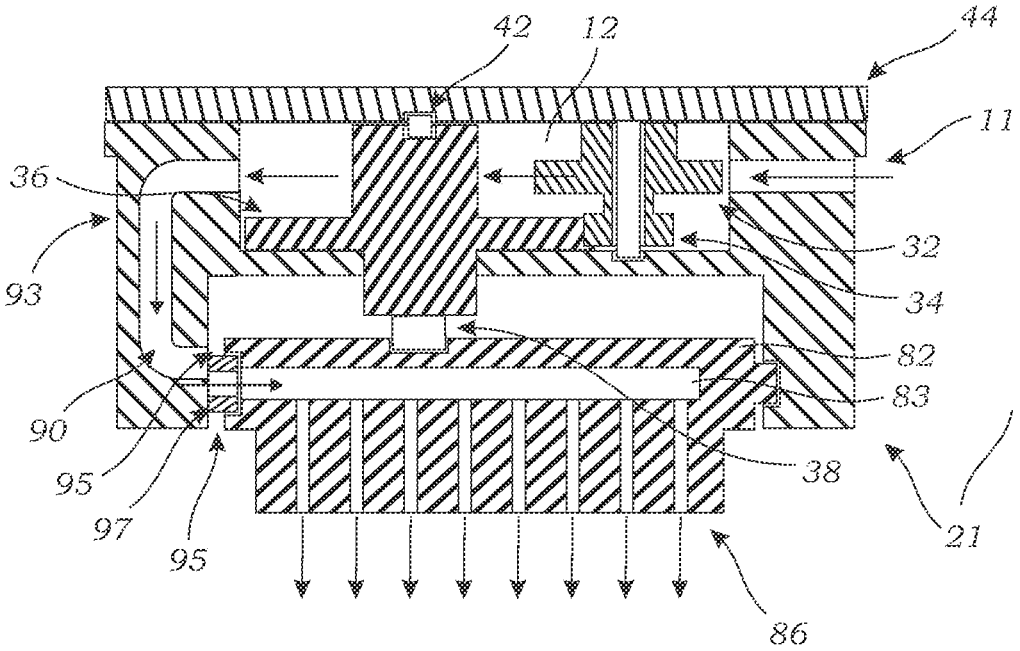
FIG. 6 is a perspective cutaway view of the compound gear mechanism illustrated in FIG. 4 illustrating the flow of water through the gear train and nozzle chamber system, wherein water is ejected from the oscillating nozzle outlet at its midpoint range of motion.
Figure 7:
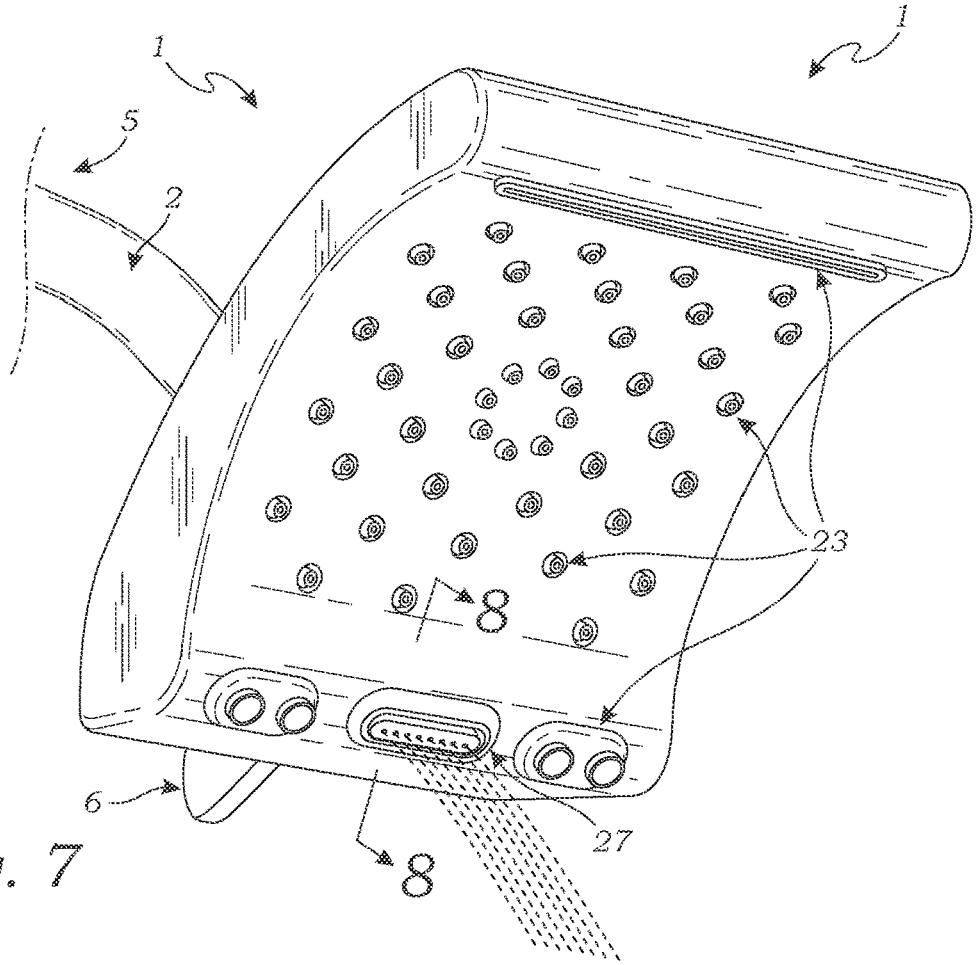
FIG. 7 is a left perspective view of the showerhead assembly illustrated in FIG. 1 wherein the oscillating nozzle is expelling water at a downward angle.
Figure 8:
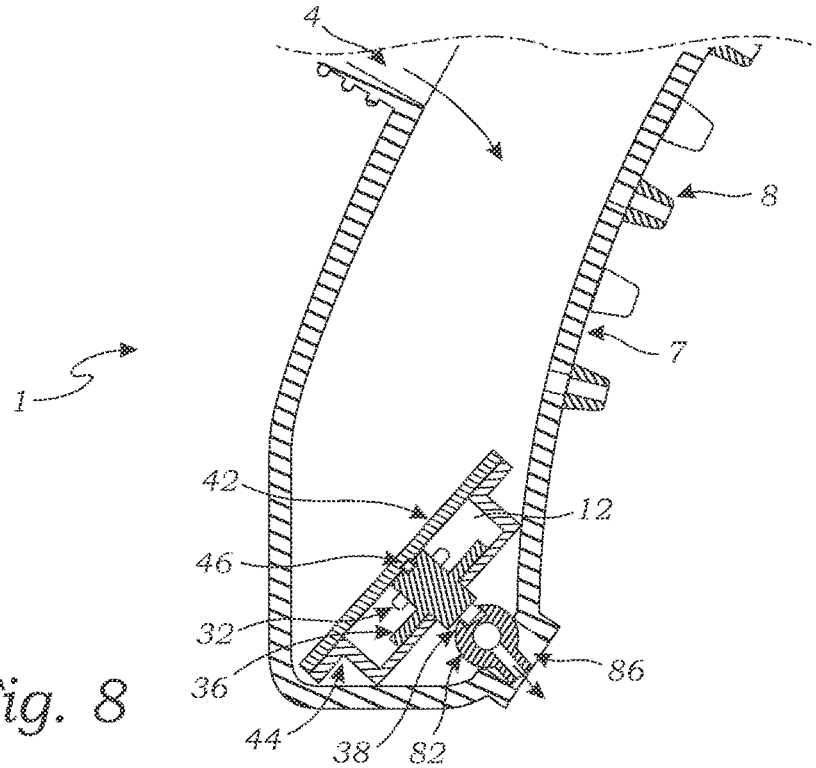
FIG. 8 is a left side cutaway view of the showerhead assembly illustrated in FIG. 1 wherein the compound gear mechanism is housed within the showerhead housing, illustrating the flow of water from the conduit through the gear train, whereby water is released into the nozzle chamber system and ejected from the oscillating nozzle outlet at a downward angle.
Figure 9:
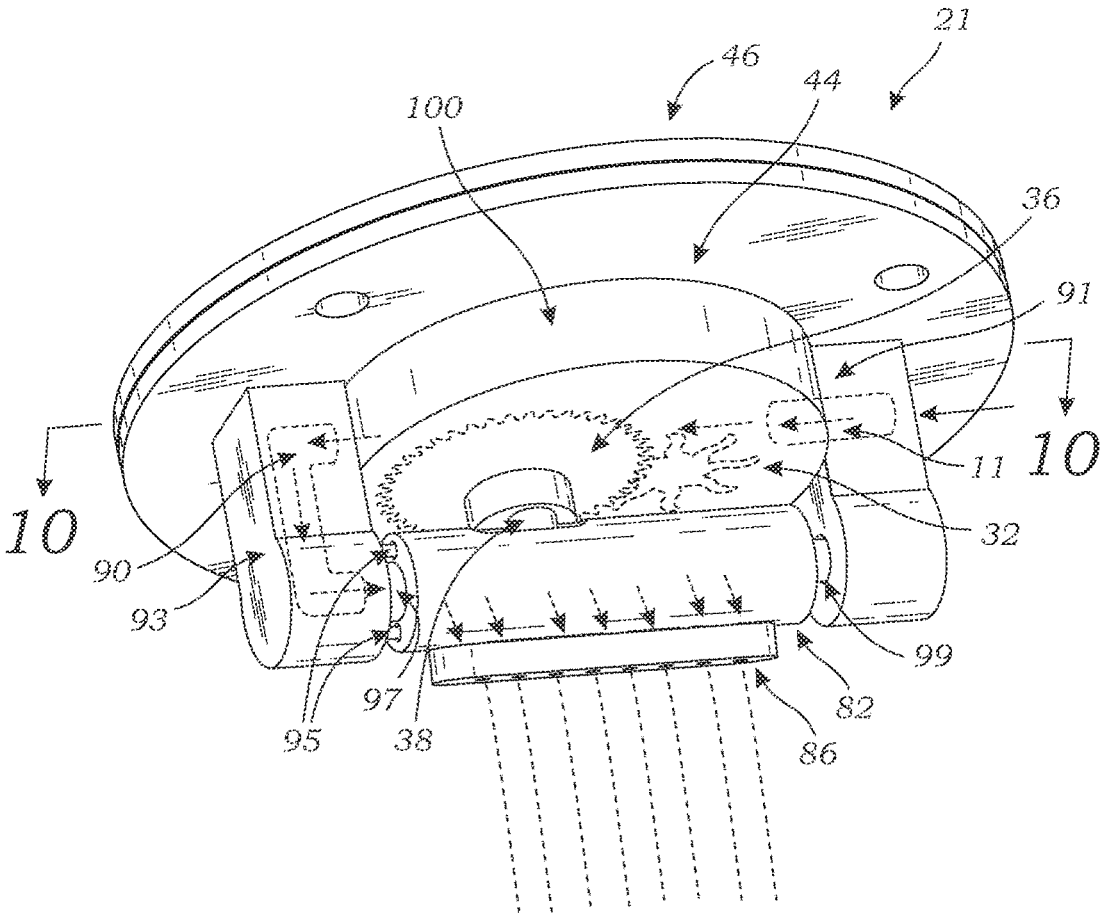
FIG. 9 is a perspective view of the compound gear mechanism illustrated in FIG. 4 illustrating gear train adjoined to the nozzle chamber system and the flow of water from the gear train through nozzle chamber system, whereby such water is ejected from the oscillating nozzle outlet at a downward angle.
Figure 10:
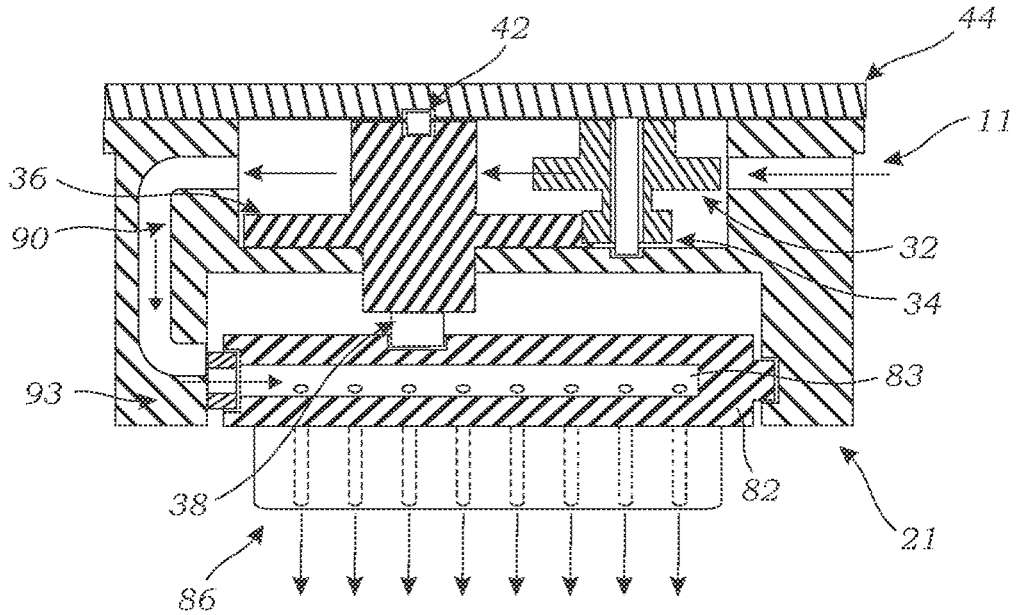
FIG. 10 is a perspective cutaway view of the compound gear mechanism illustrated in FIG. 4 illustrating the flow of water through the gear train and nozzle chamber system, wherein water is ejected from the oscillating nozzle outlet at a downward angle.
Figure 11:
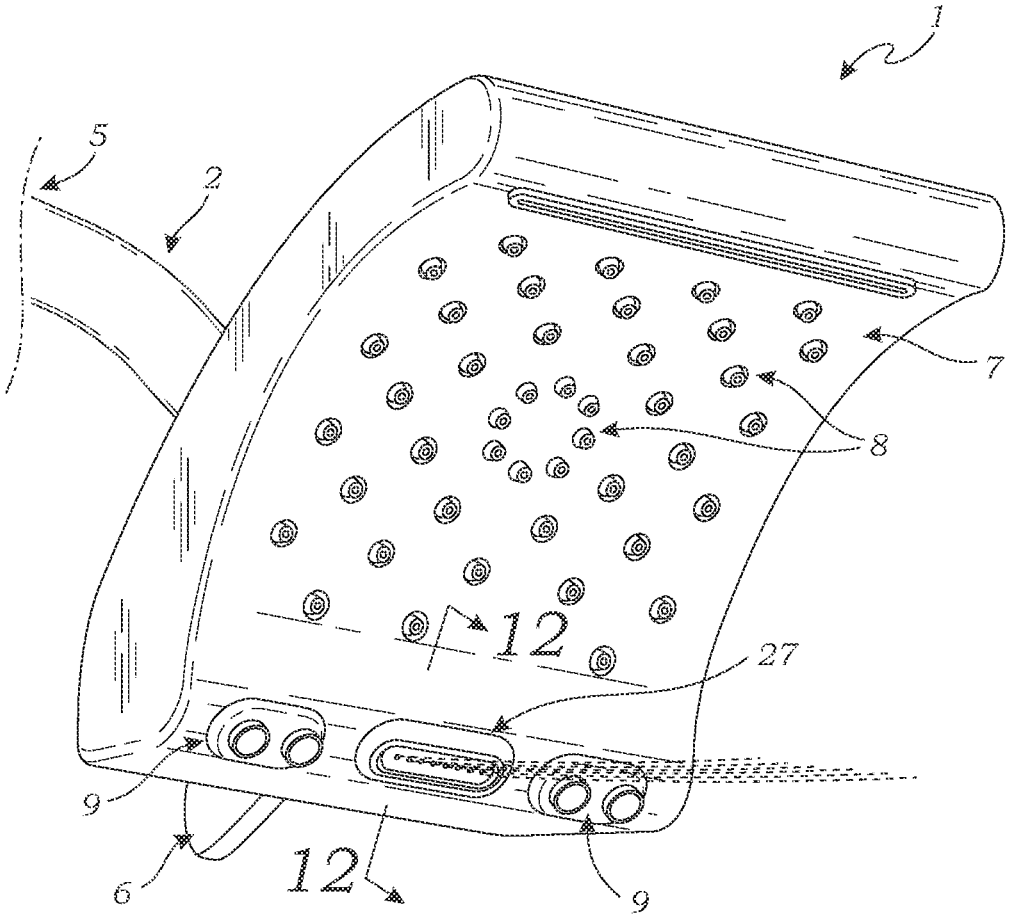
FIG. 11 is a left perspective view of the showerhead assembly wherein the oscillating nozzle is expelling water at an upward angle.
Figure 12:
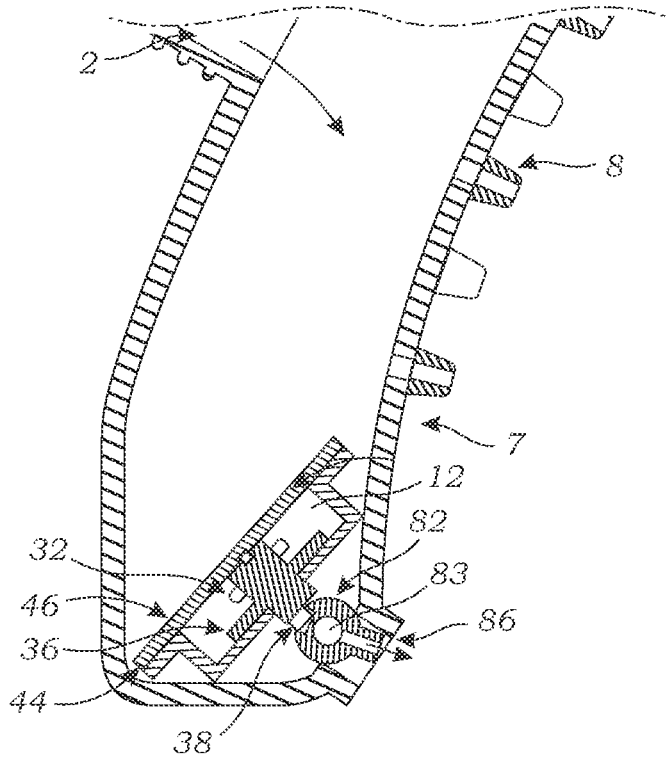
FIG. 12 is a left side cutaway view of the showerhead assembly illustrated in FIG. wherein the compound gear mechanism is housed within the showerhead housing, illustrating the flow of water from the conduit through the gear train, whereby water is released into the nozzle chamber system and ejected from the oscillating nozzle outlet at an upward angle.
Figure 13:
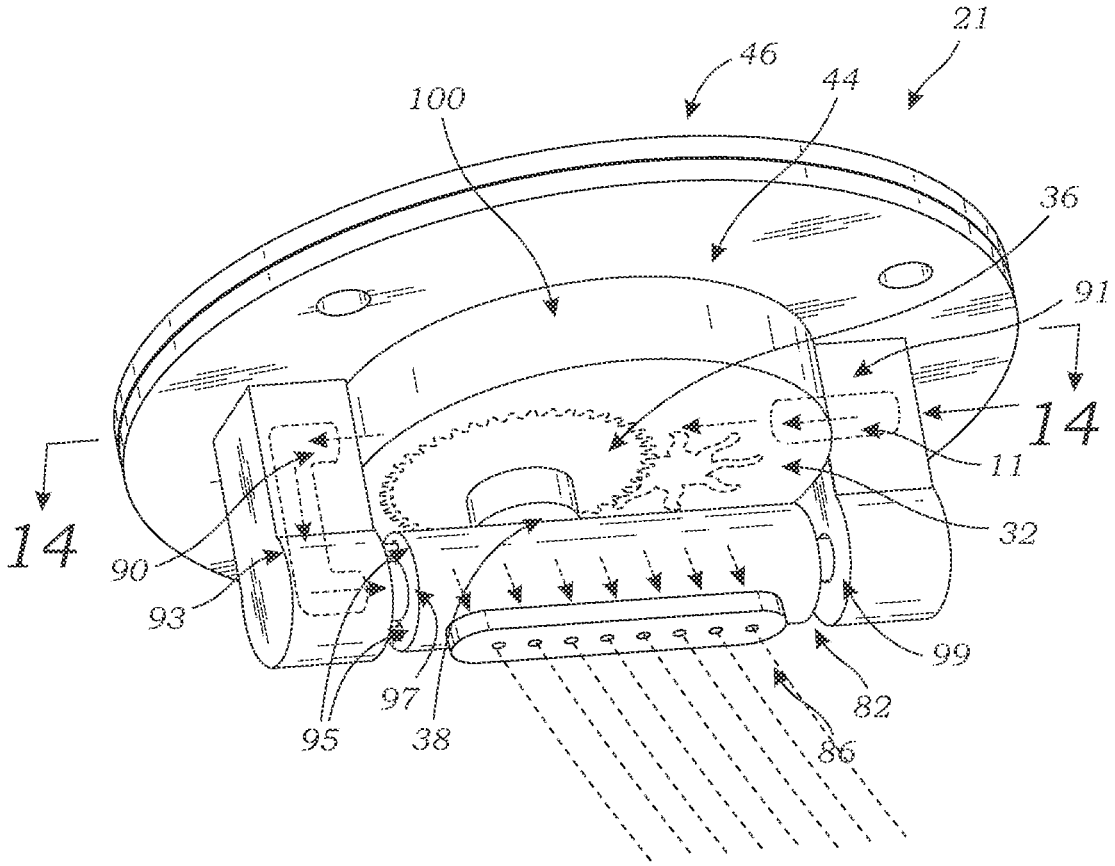
FIG. 13 is a perspective view of the compound gear mechanism illustrated in FIG. 4 illustrating gear train adjoined to the nozzle chamber system and the flow of water from the gear train through nozzle chamber system, whereby such water is ejected from the oscillating nozzle outlet at an upward angle.
Figure 14:
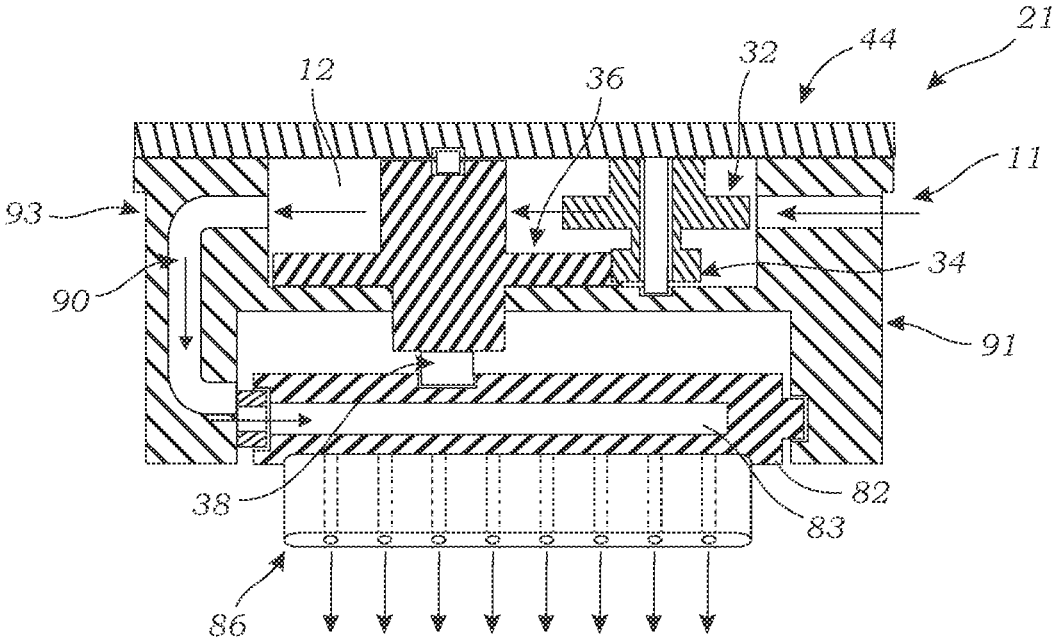
FIG. 14 is a perspective cutaway view of the compound gear mechanism illustrated in FIG. 4 illustrating the flow of water through the gear train and nozzle chamber system, wherein water is ejected from the oscillating nozzle outlet at an upward angle.
Figure 15:
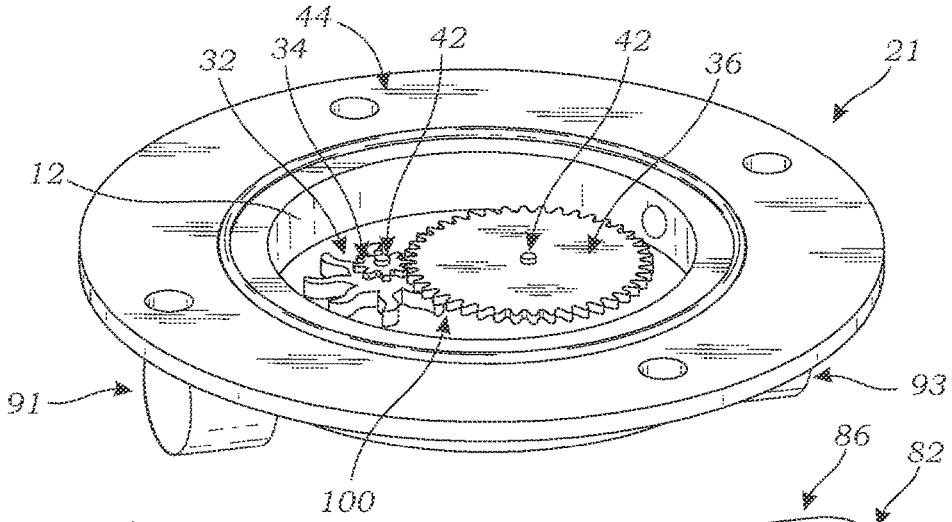
FIG. 15 is a bottom perspective view of the compound gear mechanism illustrated in FIG. 4 illustrating the layout of the gear train affixed to the front plate.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1-17, the oscillating nozzle 27 of the present invention is illustrated as a showerhead assembly 1 which includes three primary components including: a fluid conduit 2, a gear train 30, and an oscillating nozzle chamber system 80. In addition, the showerhead assembly 1 may include a face 7 that projects primary nozzles 8 and any number of supplementary nozzles 9. Further, the supplementary nozzles 9 may include any combination of oscillating nozzles 27 and/or non-oscillating nozzles 23. For example, in FIGS. 1-3, 7 and 11, the showerhead face 7 includes primary nozzles 8, oscillating nozzles 27, non-oscillating nozzles 23, and a supplemental nozzle 9 in the form of a slot nozzle 10. Preferably, the showerhead face 7 includes various types of nozzle sets in combination with the oscillating nozzle 27 so as to provide a more unique shower experience for the user. Further, both the oscillating nozzle 27 and non-oscillating nozzles 23 are embedded in a showerhead's face 7 and are in fluid connection with the conduit 2.

The showerhead may be any type as can be determined by one skilled in the art including fixed, handheld, or a combination thereof. However, for purposes of illustration only, a preferred showerhead assembly 1 includes a neck portion 6 which houses the conduit 2 and is connected to a water source 5. Further, the conduit 2 includes an inlet 4 threadably affixed to the water source pipe. The inlet 4 receives water from the water source 5 and transports such water to the inner chamber of the showerhead face 7 so as to convey such water to oscillating nozzles 27 and non-oscillating nozzles 23. Particularly, the inlet 4 transports water to a water passageway 11 upstream, directly adjacent to and in fluid connection with the gear train 30.

The gear train 30 includes three gear portions: a propeller 32, a toothed pinion 34, and a large toothed gear 36. Specifically, water flows through the water passageway 11 into a cavity 12. The water then passes through the propeller 32, thereby causing the propeller 32 to rotate in a counter-clockwise direction. Even more specifically, the pinion 34 extends co-axially from the propeller 32 and rotates in a counter-clockwise direction upon counter-clockwise rotation of the propeller 32. Additionally, the large gear 36 is in toothed engagement with the pinion 34 so as to rotate by rotation of the pinion. Specifically, the large gear 36 revolves in a clockwise direction as the pinion 34 rotates counter-clockwise, and water continues to flow through the entirety of the gear train 30. Of course, those skilled in the art would understand that the gear train may be constructed to provide clockwise rotation of the propeller and toothed pinion, and counterclockwise rotation of the large gear. Thus, the direction that the gears spin is not intended to limit the present invention.

In the preferred embodiment, the three wheel portions are mounted by arbors 42 onto a gear housing 100 so as to allow the gear train 30 to rotatably pivot as water passes through the compound gear mechanism 21. Further, the gear housing 100 includes a front plate 44 and a back plate 46. Preferably, the front plate 44 is appended to a back plate 46 which forms the cover of the three wheel gear mechanism 21. In a preferred embodiment, the front plate and back plate are circular in shape.

Figure 16:
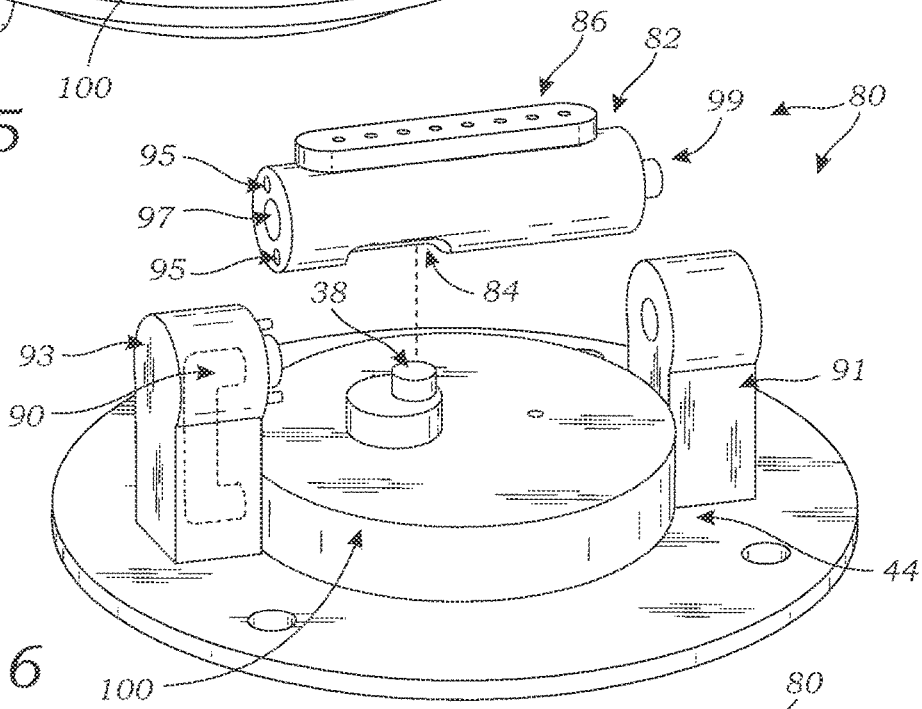
FIG. 16 is a partially exploded top view of the compound gear mechanism illustrated in FIG. 4 illustrating the nozzle chamber's pin slot which seats the pin residing on the large gear of the gear train.
Figure 17:
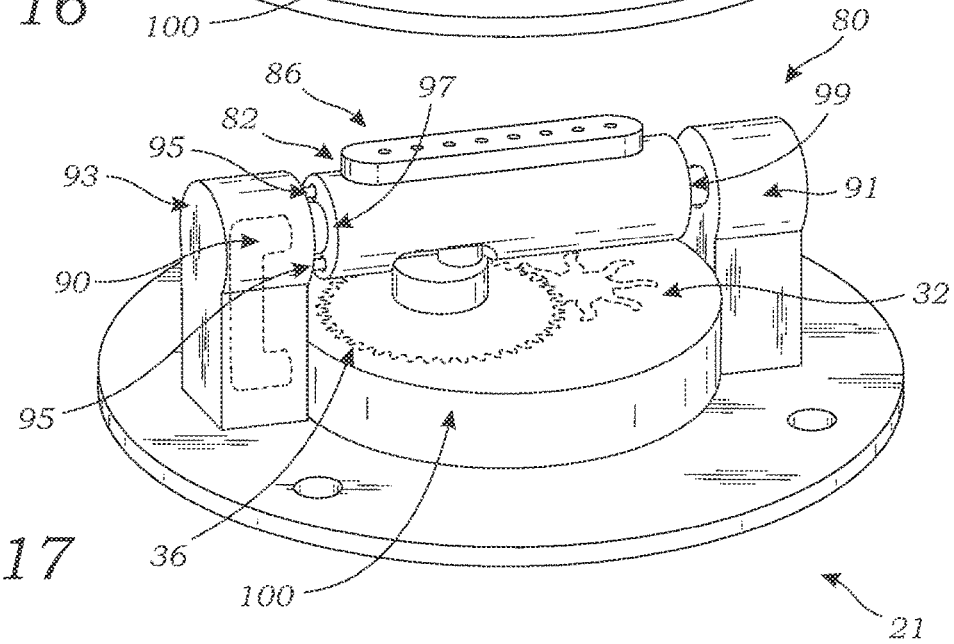
FIG. 17 is a top view of the compound gear mechanism illustrated in FIG. 4 illustrating the layout of the gear train and nozzle chamber system.

As illustrated in FIGS. 16-17, the oscillating nozzle chamber system 80 includes two shoulder arms 25 and a cylindrical nozzle housing 82 having a central chamber 83. Preferably, a pin 38 is seated on the surface of the large gear 36 and engages with the pin slot 84 located on the cylindrical nozzle housing 82 so as to work in concert with the nozzle chamber system 80, ultimately leading to the nozzle's 27 oscillating motion. Specifically, as the large gear 36 rotates, the pin 38 oscillates 45° back and forth within the pin slot 84. More specifically, the oscillating movement of the pin 38 causes the nozzle housing 82 to rotate.

Moreover, water passes through the nozzle chamber system 80. The nozzle chamber system 80 is comprised of two shoulder arms 25: a right solid shoulder arm 91 and a left hollow shoulder arm 93. The left hollow shoulder arm 93 houses the central channel 90 which receives water from the cavity 12. Further, the right shoulder arm 91 functions as a support arm for the nozzle housing 82. Notably, the two shoulder arms 25 hold the nozzle housing 82 in position along a longitudinal axis so as to prevent horizontal movement as water sprays out of the oscillating nozzle chamber's outlet 86.

In the preferred embodiment, the nozzle housing 82 includes a first end and a second end. Additionally, two spindles 95 encircle the exit of the central channel 90 and adjoin the left shoulder arm 93 to the nozzle housing 82 by the first end. Specifically, the two spindles 95 include a bearing 97 and rotate between ten degrees and thirty degrees in an upward and downward trajectory upon movement of the nozzle housing 82 caused by the pivoting of the pin 38 in the pin slot 84. More specifically, the pin's 38 movement causes the ten-to-thirty-degree vertical oscillation of the two spindles 95.

Also preferably, the right shoulder arm 91 is adjoined to the second end of the nozzle housing 82 by way of an axle 99. Specifically, and as a result of the pin 38 pivoting within the pin slot 84 and causing the nozzle housing 82 to rotate, the axle 99 oscillates between ten degrees and thirty degrees upwardly and downwardly upon a vertical axis. Importantly, the oscillating pin 38 forces the nozzle housing 82 to pivot back and forth with a rotation between ten and twenty degrees while the two shoulder arms 25 hinder the nozzle housing's 82 horizontal movement. Further, the pin system, in combination with the functions of the shoulder arms 25, restricts the nozzle housing's 82 movement along a vertical axis so as to generate the reciprocating motion of the nozzle housing 82.

As illustrated in FIGS. 5-6, 9-10, and 13-14, a nozzle outlet 86 extends from the nozzle housing 82. As water from the central channel 90 enters the nozzle housing's central cavity 83, it is ejected out through the nozzle outlet 86. As a result of the reciprocating motion of the nozzle housing 82 caused by the oscillating pin 38, such water disperses out of the nozzle outlet 86 in an oscillating spray pattern.

Preferably, and as illustrated in FIGS. 12-17, the cavity 12 is substantially larger than the diameter of the propeller 32, pinion 34, and large toothed gear 36. This disparity in size provides a space around the gear train 30 through which water can flow. The additional space is provided to account for bathers who attempt to physically hold the cylindrical nozzle chamber 82 in a fixed position. Without this additional space, water flow would be completely blocked which could result in a build-up of water pressure that could damage the internal components of the showerhead. Instead, if movement of the cylindrical nozzle housing 82 is impeded, water continues to flow around the propeller 32, pinion 34 and large toothed gear 36, and then through the central channel 90 to the nozzle housing's central cavity 83. Thus, even though the movement of the nozzle housing is impeded, water is still ejected out through the nozzle outlet 86. Once the nozzle housing's movement is once again unobstructed, the oscillating motion starts again.

While a preferred oscillating nozzle 27 and showerhead assembly 1 have been illustrated and described, it would be apparent that various modifications of the oscillating nozzle 27 and showerhead assembly 1 can be made without departing from the spirit and scope of the invention. For example, the illustrated and described preferred embodiment is a fixed wall mounted showerhead. However, the oscillating spray assembly can be incorporated into any showerhead assembly including a hand-held construction. Moreover, the preferred embodiment has a nozzle housing 82 that rotates about a horizontal axis so as to provide a spray that oscillates up and down. However, the nozzle housing may be oriented in any direction, such as vertically to provide a spray that oscillates side-to-side.

Accordingly, it is not intended that the invention be limited except by the following claims. Having described my invention in such terms to enable a person skilled in the art to understand the invention, recreate the invention, and practice it, and having identified the presently preferred embodiments thereof,

I claim:

1. A water spraying assembly comprising:

a female threaded inlet;

a showerhead having a face and a neck portion with a central conduit in fluid connection with said female threaded inlet;

an oscillating nozzle assembly including a nozzle housing having a central chamber and a one or more nozzles in fluid communication with said central chamber, said nozzle housing having a longitudinal axis, said nozzle housing further including a slot formed in the exterior of said nozzle housing which extends longitudinally in a direction of said nozzle housing's longitudinal axis;

a gear housing located within said showerhead, said gear housing including a cavity, first and second parallel shoulders adjacent to said cavity, a passageway in fluid communication with said showerhead's central conduit providing for the passage of water into said cavity; and a channel which extends from said cavity through said second shoulder, said nozzle being rotatably affixed between said first and second shoulders so as to rotate about said longitudinal axis and with said second shoulder's channel connected to said nozzle's central chamber so that water can flow from said showerhead's central conduit through said passageway to said gear housing's cavity and then through said second shoulder's channel to said nozzle's central chamber to be expelled through said one or more nozzles; and a gear train positioned within said gear housing, said gear train including a propeller, a toothed pinion extending co-axially from said propeller, and a large toothed gear in toothed engagement with said toothed pinion, said large toothed gear having a pin which extend parallel but offset from said large toothed gear's axis of rotation, and said pin positioned to extend into said nozzle housing's slot so that rotation of said large toothed gear and pin causes said nozzle housing to oscillate about said longitudinal axis, said propeller positioned within said gear housing's cavity adjacent to said gear housing's passageway so that water entering said cavity causes said propeller to spin thereby causing said toothed pinion and large toothed gear to rotate and said nozzle housing to oscillate.

2. A water spraying assembly of claim 1 wherein said showerhead face includes at least one non-oscillating nozzle.

3. A water spraying assembly of claim 1 wherein said cylindrical housing oscillates more than 30 degrees backward and forward.

* * * * *